United States Patent [19]

Carey, Jr. et al.

[11] Patent Number: 4,803,933

[45] Date of Patent: Feb. 14, 1989

[54] REFRACTORY BRICK HAVING AN INCREASED INSULATING VALUE

[75] Inventors: Loucius Carey, Jr., Pittsburgh; Leigh F. Brooks, Clairton, both of Pa.

[73] Assignee: Dresser Industries, Inc., Dallas, Tex.

[21] Appl. No.: 666,532

[22] Filed: Oct. 30, 1984

[51] Int. Cl.[4] ..... F23M 5/02

[52] U.S. Cl. ..... 110/338; 110/323; 110/332; 110/336

[58] Field of Search ..... 110/172, 173 R, 322, 110/323, 331, 332, 333, 334, 335, 336, 338, 339, 340

[56] References Cited

U.S. PATENT DOCUMENTS

| | | | |
|---|---|---|---|
| 1,410,729 | 3/1922 | Balz | 110/338 |
| 1,463,971 | 8/1923 | Poppenhusen | 110/334 |
| 2,641,205 | 6/1953 | Dolezal | 110/336 |
| 2,985,442 | 5/1961 | Hilber | 110/331 |
| 4,261,154 | 4/1981 | Mazur | 110/340 |

FOREIGN PATENT DOCUMENTS

| | | | |
|---|---|---|---|
| 224224 | 12/1983 | Japan | 110/322 |

OTHER PUBLICATIONS

McGraw-Hill Encyclopedia of Science and Technology, vol. 11, pp. 421–422, C. 1971.

"Rib Back Liners Two Shape System", North American Refractories Co., Cleveland, Ohio.

"Kod-Shell Insulating Kiln Liners", General Refractories Co., Pittsburgh, Pa., Jul. 1981.

*Primary Examiner*—Steven E. Warner

*Attorney, Agent, or Firm*—Sigalos, Levine & Montgomery

[57] ABSTRACT

A refractory brick includes at least one insulation insert located on the cold face of the brick. Heat reflective means is provided on the surface of the insert disposed parallel to the cold face of the brick to reduce the amount of heat radiated through the insert.

5 Claims, 1 Drawing Sheet

REFRACTORY BRICK HAVING AN INCREASED INSULATING VALUE

BACKGROUND OF THE INVENTION

The present invention relates to refractory brick used to form linings of vessels and in particular, the invention improves the insulating value of such brick.

Refractory brick are used, among other purposes, to form liners for vessels such as rotary kilns, steel ladles, and other high temperature vessels. In some such brick, insulation inserts are provided on the recessed cold face of the brick to improve the total insulating efficiency. The inserts are generally manufactured from low density compositions, such as ceramic fiberboard, which is an excellent insulator against heat loss through conduction. However, it has been found that a relatively large quantity of heat is radiated through the insulation insert. The radiation of such heat represents a significant portion of the total heat transfer and has a profound effect on fuel consumption.

Accordingly, it is an object of the invention to decrease the amount of heat transferred through the refractory brick, to decrease the amount of fuel consumption, and to reduce the shell temperature of the vessel.

SUMMARY OF THE INVENTION

The foregoing object is obtained in a refractory brick having at least one insulation insert located on the recessed cold face of the brick. Heat reflective means is provided on a surface of the insert disposed parallel to the cold face of the brick to reduce the amount of heat radiated through the insert.

DESCRIPTION OF THE PREFERRED EMBODIMENT

Figure 1:
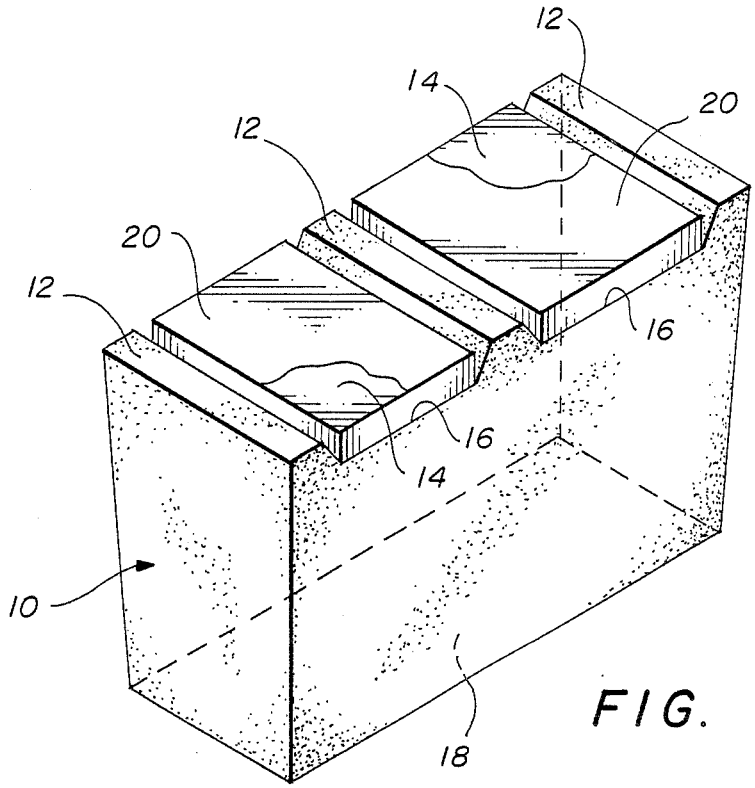
FIG. 1 is a perspective view of a refractory brick, the type to which the present inventions pertains.

Referring now to FIG. 1 of the drawing, there is disclosed a first embodiment of the present invention. In particular, a refractory brick is illustrated. Refractory brick 10 includes an insert 14 placed on the recessed cold face 12 of the brick. Brick of the type illustrated is used to form liners for vessels such as rotary kilns. The hot face 18 of the brick is exposed to process conditions within the vessel. The brick may be made from any well known refractory compositions such as alumina, magnesite-chrome, etc.

It has been found that a relatively large quantity of heat passing through the refractory brick is radiated through insert 14. The radiation of such heat results in an increased temperature of the vessel's shell and a decreased efficiency of operation of the process, since greater quantities of fuel must be consumed to maintain process temperatures to compensate for the lost radiated heat.

To overcome the heat radiation problem, it has been found that suitable heat reflective means 20 should preferably be placed on the face of insulation insert 14 which is parallel to and closest to cold face 12 of the brick. The heat reflective means significantly reduces the amount of heat radiated through insert 14. Since the process temperatures within the vessel are generally high, the reflective means must be able to withstand such high temperatures without oxidizing or otherwise deteriorating. Aluminum foil can be used as the heat reflective means as such means has very low emissivity and absorptivity.

To further increase the insulating value of brick 10, additional heat reflective means, such as foil, may be installed at the brick-insulation insert interface 16. As an alternative, a highly reflective paint, such as aluminum paint, can be applied to the brick at the brick-insulation insert interface to provide additional heat reflective means.

Typically, insulation insert 14 is made from ceramic fiberboard or similar material. Such material has low density and is an extremely good insulator against heat losses through conduction, but is a relatively poor insulator against heat losses through radiation. The utilization of suitable heat reflective means, in combination with the insert, provides excellent insulation against both conductive and radiant heat losses.

By utilizing the heat reflective means as described herein, the insulating value of brick can be significantly increased since the quantity of heat radiated through the insulation insert is significantly reduced.

Figure 2:
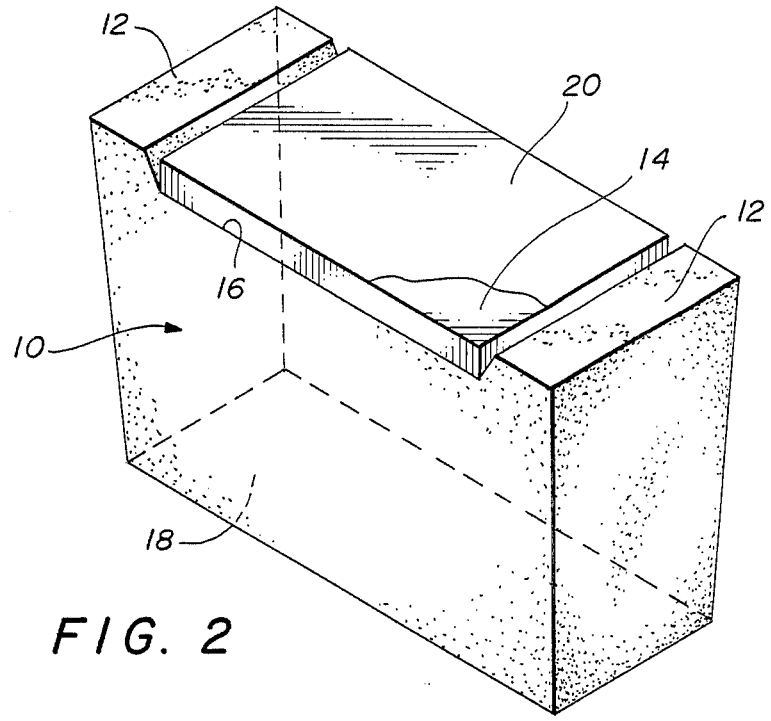
FIG. 2 is a perspective view of an alternate refractory brick in accordance with the invention.

Referring to FIG. 2, there is disclosed an alternative embodiment of the invention. In this embodiment, cold face 12 includes a pair of recessed surfaces, each of which has an insert 14 placed therein. Each insert 14 includes heat reflective means 20 on the face thereof that is parallel and closest to cold face 12 of the brick.

A first series of tests were conducted. To conduct the tests, a panel of test brick was assembled in the doorway of a reheat kiln. The kiln was subjected to a prescribed heating schedule. Panel one was constructed from refractory brick having insulation inserts. Aluminum foil was attached to the hot face of each insulation insert. A $\frac{1}{8}$ inch thick steel shell was butted against the cold face of the brick. The kiln was heated to 2000° F. over a three-hour period and held at this temperature for eight hours. Measurements were then taken at 13 points on the shell. Upon completion of these measurements, the kiln temperature was raised to 2500° F. and held for 20 hours. A second set of shell temperature data was then recorded.

Additional test panels (2, 3, 4) were constructed. These panels were identical to panel 1, except as follows:

(a) Panel 2 inserts on the brick did not have foil on either face;

(b) Panel 3 had foil on the cold faces of the inserts; and (c) Panel 4 had bricks without inserts.

The tests for panels 2 through 4 were conducted in the same manner as for panel 1.

A comparison of the data recorded during the tests indicated the following results:

(1) Use of aluminum foil on the hot face of the insulation insert provided no significant increase in the thermal resistance of the brick (compare tests 1 and 2);

(2) Application of foil to the cold face of the insulation inserts resulted in significant reductions in heat loss (compare tests 2 and 3); and (3) Visual inspection of the aluminum foil after testing panel 3 revealed no sign of oxidation.

| Panel 1 - Shell Temperatures (°F.) 2000° F. Kiln | | |
|---|---|---|
| Location | First Reading | Second Reading |
| 1 | 593 | 588 |
| 2 | 570 | 572 |
| 3 | 599 | 606 |
| 4 | 585 | 584 |
| 5 | 593 | 592 |
| 6 | 579 | 576 |
| 7 | 570 | 565 |
| 8 | 573 | 579 |
| 9 | 573 | 573 |
| 10 | 604 | 610 |
| 11 | 587 | 591 |
| 12 | 574 | 576 |
| 13 | 579 | 578 |

| Panel 3 - Shell Temperatures (°F.) 2000° F. Kiln | | |
|---|---|---|
| Location | First Reading | Second Reading |
| 1 | 424 | 425 |
| 2 | 412 | 413 |
| 3 | 434 | 438 |
| 4 | 443 | 442 |
| 5 | 463 | 465 |
| 6 | 398 | 397 |
| 7 | 401 | 402 |
| 8 | 414 | 418 |
| 9 | 429 | 431 |
| 10 | 468 | 470 |
| 11 | 451 | 458 |
| 12 | 435 | 441 |
| 13 | 411 | 419 |

| Panel 1 - Shell Temperatures (°F.) 2500° F. Kiln | | |
|---|---|---|
| Location | First Reading | Second Reading |
| 1 | 712 | 707 |
| 2 | 680 | 685 |
| 3 | 726 | 731 |
| 4 | 695 | 699 |
| 5 | 682 | 686 |
| 6 | 701 | 706 |
| 7 | 672 | 675 |
| 8 | 688 | 693 |
| 9 | 680 | 679 |
| 10 | 737 | 733 |
| 11 | 692 | 691 |
| 12 | 672 | 670 |
| 13 | 683 | 683 |

| Panel 3 - Shell Temperatures (°F.) 2500° F. Kiln | | |
|---|---|---|
| Location | First Reading | Second Reading |
| 1 | 595 | 588 |
| 2 | 570 | 564 |
| 3 | 607 | 593 |
| 4 | 607 | 600 |
| 5 | 622 | 621 |
| 6 | 558 | 554 |
| 7 | 560 | 557 |
| 8 | 611 | 611 |
| 9 | 605 | 607 |
| 10 | 667 | 664 |
| 11 | 628 | 624 |
| 12 | 588 | 587 |
| 13 | 557 | 557 |

| Panel 2 - Shell Temperatures (°F.) 2000° F. Kiln | | |
|---|---|---|
| Location | First Reading | Second Reading |
| 1 | 534 | 551 |
| 2 | 528 | 535 |
| 3 | 539 | 550 |
| 4 | 540 | 554 |
| 5 | 553 | 563 |
| 6 | 517 | 526 |
| 7 | 525 | 528 |
| 8 | 538 | 544 |
| 9 | 551 | 556 |
| 10 | 587 | 593 |
| 11 | 572 | 579 |
| 12 | 555 | 560 |
| 13 | 542 | 546 |

| Panel 4 - Shell Temperatures (°F.) 2000° F. Kiln | | |
|---|---|---|
| Location | First Reading | Second Reading |
| 1 | 532 | 525 |
| 2 | 531 | 526 |
| 3 | 536 | 534 |
| 4 | 539 | 539 |
| 5 | 556 | 560 |
| 6 | 479 | 483 |
| 7 | 493 | 492 |
| 8 | 490 | 492 |
| 9 | 510 | 510 |
| 10 | 524 | 522 |
| 11 | 540 | 539 |
| 12 | 522 | 522 |
| 13 | 509 | 508 |

| Panel 2 - Shell Temperatures (°F.) 2500° F. Kiln | | |
|---|---|---|
| Location | First Reading | Second Reading |
| 1 | 723 | 721 |
| 2 | 700 | 700 |
| 3 | 718 | 709 |
| 4 | 714 | 709 |
| 5 | 703 | 709 |
| 6 | 718 | 717 |
| 7 | 709 | 706 |
| 8 | 729 | 728 |
| 9 | 726 | 725 |
| 10 | 789 | 789 |
| 11 | 743 | 738 |
| 12 | 715 | 711 |
| 13 | 708 | 705 |

| Panel 4 - Shell Temperatures (°F.) 2500° F. Kiln | | |
|---|---|---|
| Location | First Reading | Second Reading |
| 1 | 628 | 624 |
| 2 | 630 | 624 |
| 3 | 638 | 637 |
| 4 | 643 | 645 |
| 5 | 661 | 664 |
| 6 | 595 | 596 |
| 7 | 600 | 602 |
| 8 | 601 | 604 |
| 9 | 621 | 622 |
| 10 | 638 | 638 |
| 11 | 655 | 655 |
| 12 | 635 | 636 |
| 13 | 622 | 621 |

Additional tests were conducted as described hereinbelow. To prepare for the additional testing, a standard nine-inch thick brick, with an insulation insert, was cut to a five-inch thickness. This piece was then placed in the door of a work-of-fracture furnace. To complete the assembly, a 1/16-inch thick steel plate was butted against the cold face of the brick to simulate a steel shell.

To begin each test, the furnace temperature was raised at a rate of 400° F./hr to 1500° F. and held for 20½ hours. After this heating period, temperatures at three points were measured using a surface probe digital thermometer. The furnace temperature was then raised to 1900° F. and held for 7¼ hours. A second set of temperature readings was then recorded. Finally, the furnace temperature was raised to 2300° F. and held for 15½ hours after which a third set of temperatures was measured.

This testing sequence was repeated for five variations of the original brick configuration. The first, second and third variations (Tests 2, 3 and 4) consisted of attaching 0.003-inch thick aluminum foil sheet(s) to the cold face, hot face, or both faces, respectively. The fourth variation (Test 5) consisted of removing the insulation insert leaving an enclosed air space, and in the final variation (Test 6), the test brick was fitted with an insert which completely filled the indentation of the brick. The insert of Test 6 was made from the same material as the brick and thus, this last variation simulated a conventional brick. Each of these modifications was made without disturbing the original brick.

Results indicated that at all furnace temperatures, the heat flow through the brick of Test 1 was significantly less than that through the simulated conventional brick (Test 6). Also, it was shown that the thermal resistance of the brick was further improved by placing aluminum foil on either or both faces of the insulation insert (Tests 2, 3 and 4); these three variations using foil showed very similar improvements. Finally, it was revealed that the brick without the insulation insert (Test 5), but with the enclosed air space was more thermally insulating than the conventional brick (Test 6), but it provided much less improvement than did the brick with the insulation insert (Test 1).

The conclusions of the later tests and the initial tests differed in two respects. First, the magnitude of the improvement brought about by attaching aluminum foil to the cold face of the insulation insert was less in the second tests (5%) versus about 35% in the first tests. Second, the results of the current study indicated that attaching foil to the hot face of the insulation insert was equally beneficial as was attaching it to the cold face; results of the first series of tests implied that no benefit was gained by attaching foil to the hot face of the insert. No definitive explanations of these differences can be offered at this time. Nonetheless, the results of both studies agreed in proving that the use of aluminum foil on the cold face of the insulation insert is beneficial.

| Furnace Temp (°F.) | Location | Cold Face Temperature (°F.): Test 1 | Test 2 | Test 3 | Test 4 | Test 5 | Test 6 |
|---|---|---|---|---|---|---|---|
| 1500 | 1 | 472 | 460 | 463 | 456 | 480 | 489 |
| | 2 | 400 | 385 | 388 | 386 | 445 | 494 |
| | 3 | 462 | 461 | 462 | 460 | 484 | 494 |
| 1900 | 1 | 570 | 556 | 550 | 551 | 574 | 580 |
| | 2 | 472 | 455 | 454 | 452 | 534 | 586 |
| | 3 | 557 | 555 | 551 | 552 | 580 | 585 |
| 2300 | 1 | 651 | 643 | 636 | 643 | 664 | 666 |
| | 2 | 540 | 523 | 523 | 519 | 635 | 675 |
| | 3 | 644 | 646 | 650 | 646 | 669 | 675 |

While a preferred embodiment of the present invention has been described and illustrated, the invention should not be limited thereto, but may be otherwise embodied within the scope of the following claims.

The embodiments of the invention in which an exclusive property or privilege is claimed are defined as follows:

1. In a refractory brick having a recessed cold face and including at least one insulation insert located on the recessed cold face of the brick, the improvement comprising: heat reflective means provided on a surface of the insert disposed parallel to the cold face of the brick to reduce the amount of heat radiated through this region of the brick; wherein the heat reflective means is aluminum foil disposed on the cold surface of the insert.

2. In a refractory brick in accordance with claim 1 wherein the heat reflective means further includes aluminum foil disposed on the surface of the insert forming the boundary of the brick-insert interface.

3. In a refractory brick in accordance with claim 1 wherein the heat reflective means further comprises a highly reflective paint applied to the surface of the brick forming the boundary of the brick-insert interface.

4. In a refractory brick having a recessed cold face and including at least one insulation insert located on the recessed cold face of the brick, the improvement comprising: heat reflective means provided on a surface of the insert disposed parallel to the cold face of the brick to reduce the amount of heat radiated through this region of the brick; wherein the heat reflective means comprises aluminum fo disposed on the surface of the insert forming the boundary of the brick-insert interface.

5. In a refractory brick having a recessed cold face and including at least one insulation insert located on the recessed cold face of the brick, the improvement comprising: heat reflective means provided on a surface of the insert disposed parallel to the cold face of the brick to reduce the amount of heat radiated through this region of the brick; wherein the heat reflective means comprises a highly reflective paint applied to the surface of the brick forming the boundary of the brick-insert interface.

* * * * *

UNITED STATES PATENT AND TRADEMARK OFFICE

CERTIFICATE OF CORRECTION

PATENT NO. 4,803,933

DATED February 14, 1989

INVENTOR(S) Carey, et al.

It is certified that error appears in the above-identified patent and that said Letters Patent is hereby corrected as shown below:

Claim 4, line 8, cancel "fo" and substitute therefor -- foil --.

Signed and Sealed this

Twenty-fifth Day of July, 1989

*Attest:*

DONALD J. QUIGG

*Attesting Officer*

*Commissioner of Patents and Trademarks*